US011389940B2

(12) United States Patent
Roehm

(10) Patent No.: US 11,389,940 B2
(45) Date of Patent: Jul. 19, 2022

(54) HANDHELD POWER TOOL INCLUDING A SPINDLE LOCKING DEVICE

(71) Applicant: Robert Bosch GmbH, Stuttgart (DE)

(72) Inventor: Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 148 days.

(21) Appl. No.: 15/812,561

(22) Filed: Nov. 14, 2017

(65) Prior Publication Data

US 2018/0154508 A1 Jun. 7, 2018

(30) Foreign Application Priority Data

Dec. 6, 2016 (DE) ..... 102016224226.1

(51) Int. Cl.
*B25F 5/00* (2006.01)
*B25F 5/02* (2006.01)

(52) U.S. Cl.
CPC ..... *B25F 5/001* (2013.01); *B25F 5/008* (2013.01); *B25F 5/02* (2013.01)

(58) Field of Classification Search
CPC ..... B25F 5/02; B25F 5/08; B25F 5/001
See application file for complete search history.

(56) References Cited

U.S. PATENT DOCUMENTS 3,906,266 A * 9/1975 Cowman ..... B23D 47/005 310/60 R
4,901,602 A * 2/1990 Matoba ..... F16H 1/28 475/331
8,087,977 B2 * 1/2012 Gallagher ..... B25F 5/001 451/359
2007/0201748 A1 * 8/2007 Bixler ..... B25F 5/001 382/225
2009/0145259 A1 * 6/2009 Wall ..... B24B 23/022 74/527
2011/0303432 A1 * 12/2011 Stauffer ..... B25F 5/001 173/181
2011/0308828 A1 * 12/2011 Shinma ..... B25D 17/20 173/114
2012/0302147 A1 * 11/2012 Trautner ..... B24B 55/00 451/488
2012/0319509 A1 * 12/2012 Kishima ..... B23B 45/02 310/50

(Continued)

FOREIGN PATENT DOCUMENTS

CN 101220859 A 7/2008
CN 102271869 A 12/2011
EP 2647472 B1 9/2016

*Primary Examiner* — Anna K Kinsaul
*Assistant Examiner* — Daniel Jeremy Leeds
(74) *Attorney, Agent, or Firm* — Norton Rose Fulbright US LLP; Gerard Messina

(57) ABSTRACT

A handheld power tool including a tool housing, in which a drive motor for driving a drive spindle is situated, the drive spindle being assigned a tool holder for accommodating an insertion tool and the drive spindle being assigned a spindle locking device which is designed to prevent the drive spindle from twisting in relation to the tool housing during a spindle locking mode, a fan wheel is provided which is intended at least for cooling the drive motor, at least 20 percent by volume of the fan wheel including a metal having a density of greater than or equal to 3.5 g/cm$^3$.

31 Claims, 4 Drawing Sheets

(56) References Cited

U.S. PATENT DOCUMENTS

| | | | | |
|---|---|---|---|---|
| 2013/0220655 | A1* | 8/2013 | Tomayko | B25F 5/001 173/47 |
| 2013/0255981 | A1* | 10/2013 | Noto | B25F 5/001 173/20 |
| 2013/0284475 | A1* | 10/2013 | Hirabayashi | B25F 5/008 173/47 |
| 2014/0182869 | A1* | 7/2014 | Kumagai | B25B 21/026 173/93 |
| 2014/0371018 | A1* | 12/2014 | Ito | B25F 5/008 475/149 |
| 2016/0121466 | A1* | 5/2016 | Kiyohara | B25B 21/00 362/120 |
| 2016/0279783 | A1* | 9/2016 | Wang | B25F 5/001 |
| 2017/0157753 | A1* | 6/2017 | Nagasaka | B25B 21/023 |
| 2018/0264637 | A1* | 9/2018 | Kuehne | B25F 5/001 |
| 2019/0009398 | A1* | 1/2019 | Zhong | B25B 21/00 |

* cited by examiner

HANDHELD POWER TOOL INCLUDING A SPINDLE LOCKING DEVICE

CROSS REFERENCE

The present application claims the benefit under 35 U.S.C. § 119 of German Patent Application No. DE 102016224226.1 filed on Dec. 6, 2016, which is expressly incorporated herein by reference in its entirety.

BACKGROUND INFORMATION

The present invention relates to a handheld power tool including a tool housing, in which a drive motor for driving a drive spindle is situated, the drive spindle being assigned a tool holder for accommodating an insertion tool and the drive spindle being assigned a spindle locking device which is designed to prevent the drive spindle from twisting in relation to the tool housing during a spindle locking mode.

A handheld power tool of this type including a drive motor, situated in a tool housing, for driving a drive spindle is conventional. A fan wheel, which is made of plastic for weight reduction purposes, may be provided for cooling the drive motor. The drive spindle is assigned a tool holder for accommodating an insertion tool. A spindle locking device including a clamping ring and at least one blocking member is furthermore provided and the drive spindle is assigned at least one clamping surface. During a spindle locking mode of the spindle locking device the at least one blocking member is clamped between the at least one clamping surface and the clamping ring. In this way, the drive spindle is prevented from twisting in relation to the tool housing.

SUMMARY

The present invention provides a handheld power tool including a tool housing, in which a drive motor for driving a drive spindle is situated, the drive spindle being assigned a tool holder for accommodating an insertion tool and the drive spindle being assigned a spindle locking device which is designed to prevent the drive spindle from twisting in relation to the tool housing during a spindle locking mode. A fan wheel is provided which is intended at least for cooling the drive motor, at least 20 percent by volume of the fan wheel including a metal having a density of greater than or equal to 3.5 g/cm$^3$.

The present invention thus makes it possible to provide a handheld power tool which includes a spindle locking device and a fan wheel and in which it is possible to achieve an increase in a corresponding inertia of the fan wheel by designing the fan wheel to be made at least 20 percent by volume of metal, thus achieving at least an improvement of a response behavior of the spindle locking device. In this way, a handheld power tool may be provided in which the spindle locking device may largely be prevented from responding when the drive motor is running and a comparatively reliable responding of the spindle locking device may be achieved when the drive motor is at a standstill.

The fan wheel preferably includes zinc, a zinc alloy, brass and/or steel. In this way, a cost-effective and robust fan wheel may be provided.

The fan wheel preferably includes a flange for forming a force-locked connection to a drive shaft which is assigned to the drive motor. As a result, the fan wheel may be driven safely and reliably.

According to one specific embodiment, the fan wheel includes a composite material which includes at least plastic or two different metals. The metal containing at least 20 percent by volume of the fan wheel may thus be designed in a simple manner.

A gear unit is preferably situated between the drive motor and the tool holder, the gear unit being designed in the manner of a planetary gear set and includes at least one planetary stage. A stable and robust gear unit may thus be provided in a simple way.

The at least one planetary stage preferably has at least one sun wheel and a ring gear, the sun wheel being movable in the radial direction of the gear unit at least 0.2 mm in relation to the ring gear. A suitable movability of the sun wheel in relation to the ring gear may thus be made possible in a simple and uncomplicated way.

The spindle locking device is preferably situated between the gear unit and the tool holder. A mechanical stress of the gear unit may thus be limited.

A torque clutch is preferably provided which is situated between the gear unit and the tool holder. It is thus possible to decouple the tool holder from the drive when a predefined torque is exceeded and an overload may thus be prevented at least for the most part.

According to one specific embodiment, the drive motor is situated in the area of a handle which is assigned to the tool housing. In this way, a gravity center of the handheld power tool may be formed at a distance from the tool holder.

The drive motor is preferably designed in the manner of an electronically commutated drive motor including a stator and a rotor which is provided with at least one permanent magnet. In this way, a safe and reliable drive motor may be provided.

According to one specific embodiment, the drive spindle is assigned at least one clamping surface which is assigned the spindle locking device including a clamping ring and at least one blocking member, the at least one blocking member being clampable between the at least one clamping surface and the clamping ring during the spindle locking mode of the spindle locking device in order to prevent the drive spindle from twisting in relation to the tool housing.

In this way, a robust and reliable spindle locking device may be provided.

The at least one blocking member preferably has a cylindrical design. In this way, a stable and robust blocking member may be provided.

BRIEF DESCRIPTION OF THE DRAWINGS

The present invention is explained in greater detail below with reference to the exemplary embodiments shown in the figures.

DETAILED DESCRIPTION OF EXAMPLE EMBODIMENTS

Figure 1:
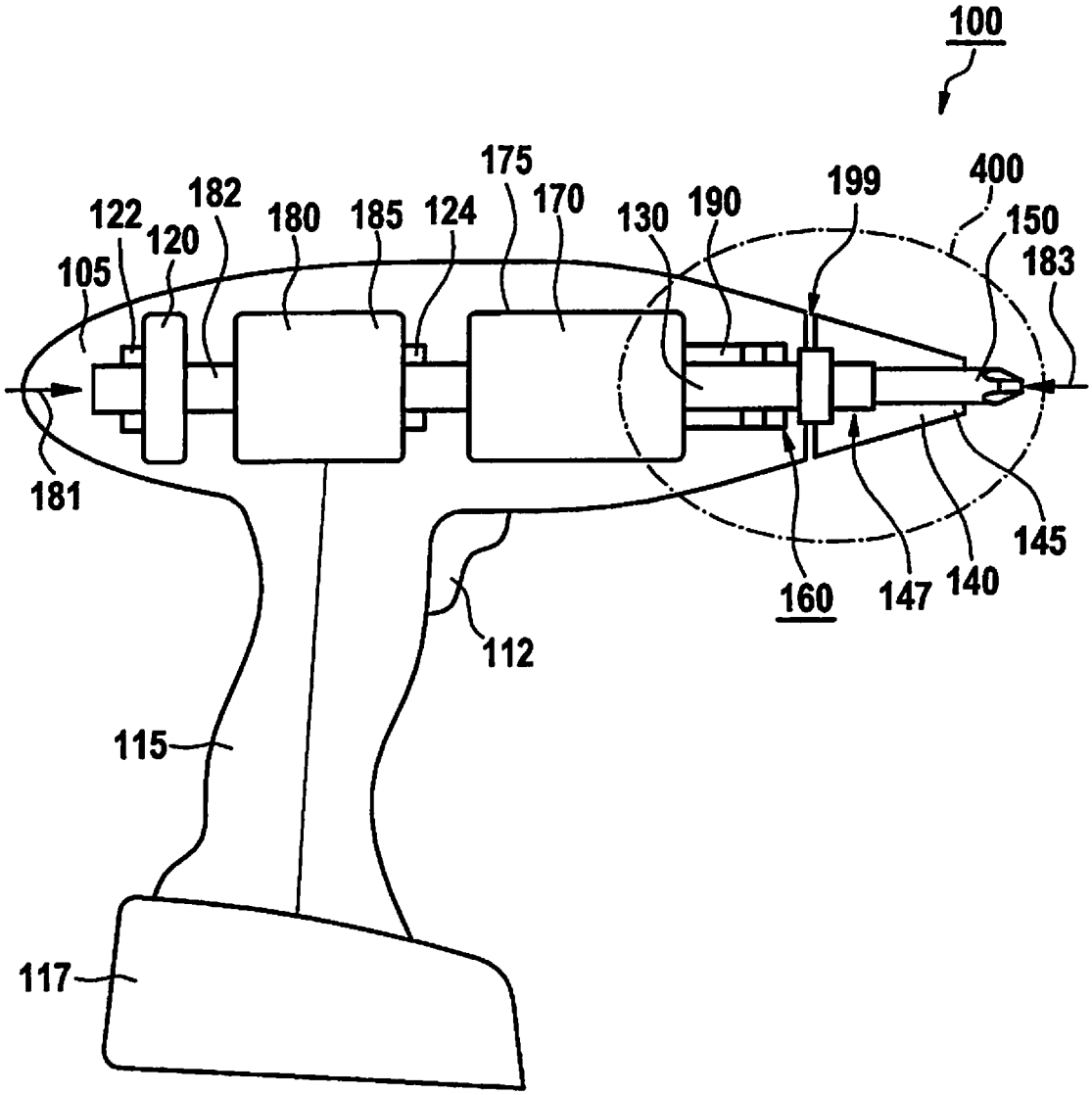
FIG. 1 shows a schematic view of a handheld power tool according to the present invention.

FIG. 1 shows a handheld power tool 100 which preferably has a tool housing 105 including a handle 115. At least one drive motor 180 is situated in tool housing 105 for driving a drive spindle 130 which is connected to a tool holder 140 and which is assigned a spindle locking device 190. Moreover, an optional torque clutch 160 is provided preferably as demonstrated.

According to one specific embodiment, handheld power tool 100 is designed in the manner of a manually guided power tool and is connectable mechanically and electrically to a rechargeable battery pack 117 for a cordless power supply. In FIG. 1, handheld power tool 100 is designed as a cordless combi drill by way of example. It is pointed out, however, that the present invention is not limited to manually guided power tools and, in particular, to cordless combi drills, but may rather be used in different handheld power tools which include a drive spindle provided with a spindle locking device—irrespective of whether these handheld power tools are operated electrically, i.e. are battery- or mains-operated, or non-electrically.

In handheld power tool 100, rechargeable battery pack 117 is used for the power supply to drive motor 180, which is designed in the manner of an electric motor by way of example. Drive motor 180 is actuatable, i.e., may be switched on and off, via a manual switch 112, for example, and is an electronically commutated motor. Drive motor 180 is preferably a DC motor including a stator (312 in FIG. 3) and a rotor (314 in FIG. 3) which is provided with at least one permanent magnet (512 in FIG. 5). In this case, drive motor 180 is preferably situated in the area of handle 115. Preferably, drive motor 180 is electronically controllable in such a way that a reverse operation as well as inputs with regard to a desired rotational speed are implementable. The mode of operation and the design of a suitable drive motor are conventional so that a detailed description thereof is dispensed with for the sake of a concise description.

Drive motor 180 is connected to drive spindle 130 via a gear unit 170 which is situated in tool housing 105. Drive motor 180 is preferably situated in a motor housing 185 and gear unit 170 in a gear unit housing 175, gear unit housing 175 and motor housing 185 being situated in tool housing 105 by way of example. Gear unit 170 is preferably situated between drive motor 180 and tool holder 140. In this case, a drive shaft 182, which is assigned to drive motor 180, is preferably connected to gear unit 170, gear unit 170 being connected to tool holder 140 via drive spindle 130.

Gear unit 170 is designed to transfer a torque, which is generated by drive motor 180, to drive spindle 130 and is, only by way of example, but not necessarily, a planetary gear set, which has different gear or planetary stages and which is rotatably driven by drive motor 180 during the operation of handheld power tool 100. It is pointed out, however, that gear unit 170 may be also dispensed with depending on a selected design of drive motor 180.

Drive spindle 130 is rotatably mounted with the aid of a bearing assembly in tool housing 105 and connected to tool holder 140 which is situated in the area of a front side 199 of tool housing 105 and includes a drill chuck 145 by way of example. According to one specific embodiment, the bearing assembly has at least two bearing points which are provided in tool housing 105 in an area downstream from gear unit 170. Tool holder 140 is used for accommodating an insertion tool 150 and may be integrally connected to drive spindle 130 or may be connected to it in the form of an attachment. In FIG. 1, tool holder 140 is designed as a type of attachment by way of example and is fastened to drive spindle 130 via a fastening device 147 provided on same.

According to one specific embodiment, drive spindle 130 is assigned spindle locking device 190, as described above, which is at least designed at least essentially to prevent drive spindle 130 from twisting in relation to tool housing 105 during the spindle locking mode. In this case, spindle locking device 190 may be triggered when drive spindle 130 twists in any arbitrary direction of rotation or only when it twists in a predefined direction of rotation. The spindle locking mode makes it possible to open or close tool holder 140 when drive motor 180 is at a standstill, for example.

Spindle locking device 190 is situated, by way of example, in the axial direction of drive spindle 130 between gear unit 170 and tool holder 140, but may also be situated alternatively in a different suitable position, for example in gear unit 170 or between gear unit 170 and drive motor 180. The mode of operation of spindle locking device 190 is conventional so that a detailed description of the mode of operation of spindle locking device 190 is dispensed with for the sake of a concise description.

At least one fan wheel 120 is preferably provided which is provided at least for cooling drive motor 180. Preferably, at least 20 percent by volume of fan wheel 120 preferably [sic] includes a metal having a density greater than or equal to 3.5 g/cm$^3$. Fan wheel 120 preferably includes zinc, a zinc alloy, brass and/or steel. Fan wheel 120 preferably includes a composite material which includes at least plastic or two different metals. In this case, fan wheel 120 preferably includes a flange (524 in FIG. 5) for forming a force-locked connection to a drive shaft 182 which is assigned to drive motor 180.

With the aid of above-described fan wheel 120, a particular response behavior of spindle locking device 190 may be at least improved, a comparatively rapid and reliable response of spindle locking device 190 being enabled when drive motor 180 is at a standstill and a response being prevented at least essentially and preferably completely when drive motor 180 is running. Moreover, the response of spindle locking device 190 may be preferably improved in the case of torque fluctuations. Improving the response behavior of spindle locking device 190 makes it possible to at least reduce wear and tear of the individual components of spindle locking device 190. In the context of the present description, a response is understood to mean that a rotational speed on the output side, for example a rotational speed of drive spindle 130, of tool holder 140, or of insertion tool 150, is greater than a rotational speed on the drive side, for example of drive motor 180 or of a planet carrier (320 in FIG. 3) assigned to gear unit 170.

In the design in which at least 20 percent by volume of fan wheel 120 includes a metal having a density greater than or equal to 3.5 g/cm$^3$, fan wheel 120 furthermore has a comparatively great inertia, thus making it possible to reduce vibrations and therefore increase a smooth running of handheld power tool 100. Fan wheel 120 according to the present invention preferably increases a rotary inertia of drive motor 180 or of its rotor (314 in FIG. 3) by preferably at least 5%, particularly preferably 10%, and ideally by more than 15% as compared to a fan wheel made of plastic. A lower reduction of a rotational speed of drive motor 180 may moreover be enabled in the case of short-term increase in load resistance. With the aid of above-described fan wheel 120, the inertia of the drive train may also be increased.

Here, drive shaft 182 is preferably mounted in each case via a bearing element 122, 124 in tool housing 105 at an end 181 facing away from tool holder 140 and/or at an end 183 facing tool holder 140. Drive shaft 182 is preferably rod-shaped. Drive shaft 182 is moreover preferably designed in the manner of a torsion shaft, a comparatively low load acting on a connection between fan wheel 120 and drive shaft 182. Fan wheel 120 is preferably situated between the two bearing elements 122, 124. Fan wheel 120 is, as demonstrated, situated between bearing element 122 and drive motor 180. In this way, an improved device balance of handheld power tool 100 may preferably be facilitated, since the center of gravity of handheld power tool 100 is situated in handle area 115.

However, fan wheel 120 may also be situated between drive motor 180 and optional gear unit 170. Furthermore, several fan wheels 120 may be present, the fan wheels being potentially situated at different positions, for example between a bearing element 122 and drive motor 180 or between drive motor 180 and gear unit 170.

Figure 2:
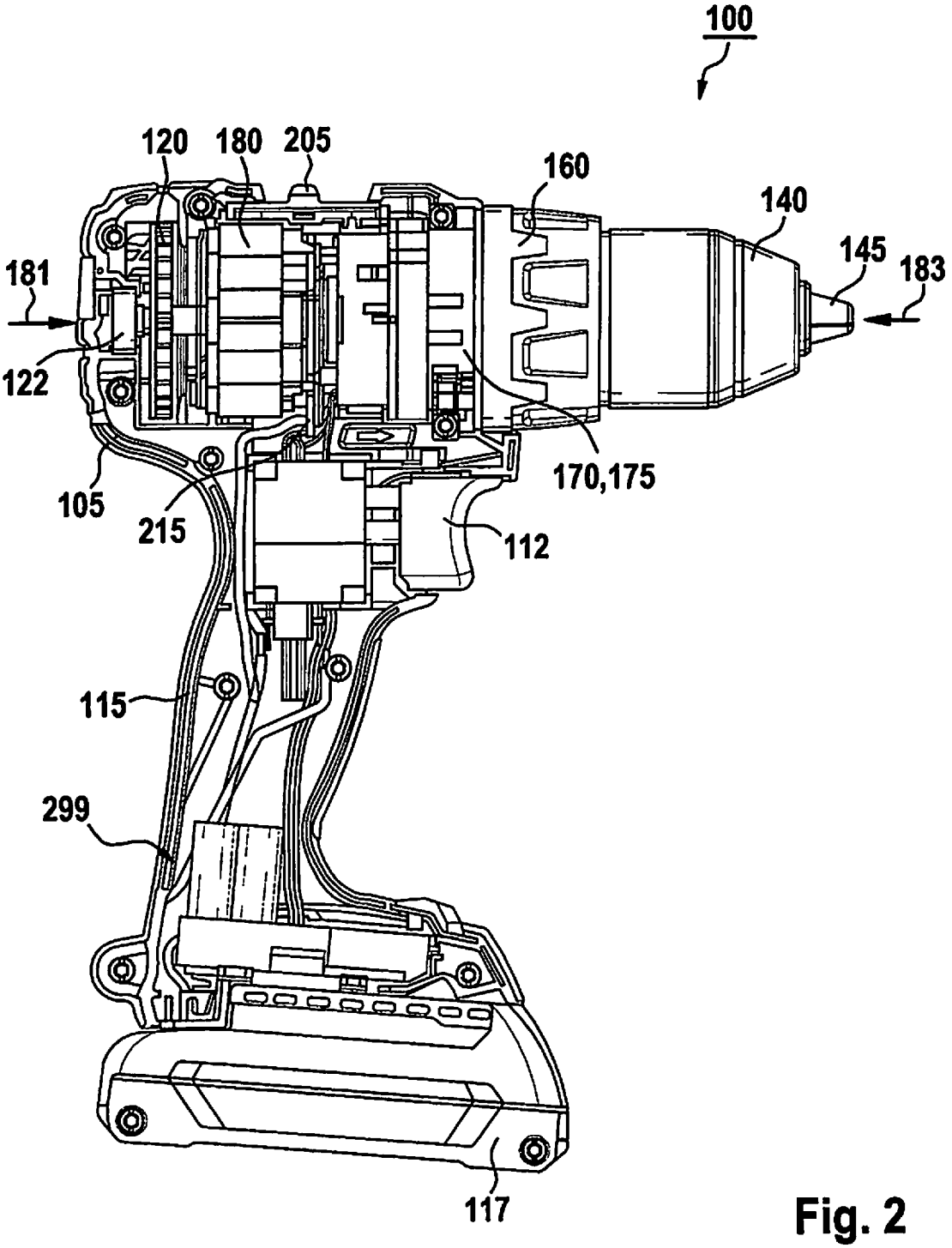
FIG. 2 shows a side view of the handheld power tool from FIG. 1 including an opened tool housing.

FIG. 2 shows handheld power tool 100 from FIG. 1 and illustrates the rotatable mounting of drive shaft 182 via bearing element 122 in tool housing 105. FIG. 2 furthermore illustrates a motor electronic system 215 assigned to drive motor 180 from FIG. 1. Motor electronic system 215 is situated between drive motor 180 and optional gear unit 170 by way of example, but it could also be situated at another arbitrary location, for example between fan wheel 120 and drive motor 180. FIG. 2 moreover shows an exemplary gear-shifting device 205 for changing a particular gear ratio of gear unit 170. A main electronic system 299 of handheld power tool 100 is furthermore preferably situated in handle area 115 between switch 112 and rechargeable battery pack 117.

Figure 3:
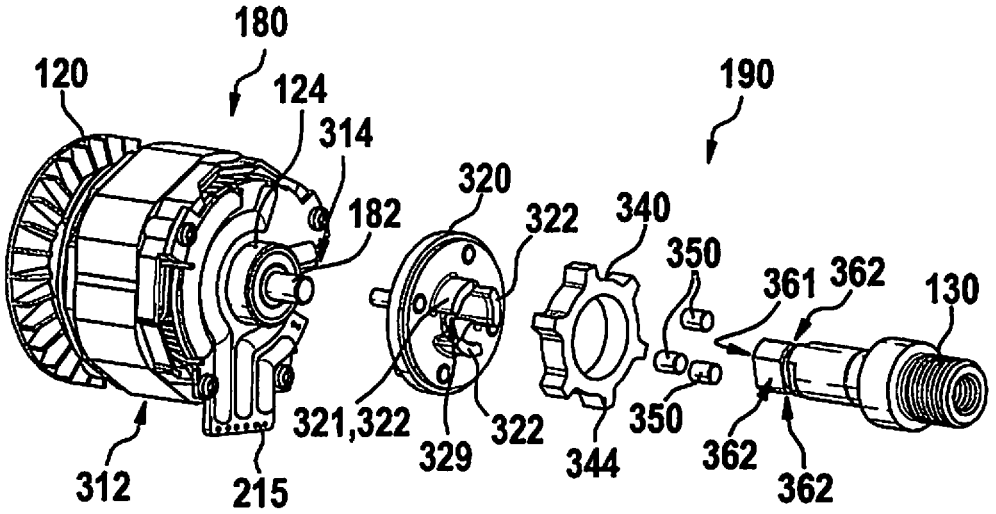
FIG. 3 shows a perspective view of a drive motor which is assigned to the handheld power tool, of a fan wheel as well as of a spindle locking device.

FIG. 3 shows fan wheel 120, drive motor 180, spindle locking device 190 as well as drive spindle 130 from FIG. 1 and FIG. 2. Here, FIG. 3 illustrates drive motor 180 which is preferably designed as an electronically commutated drive motor and which includes a stator 312 and a rotor 314. Motor electronic system 215 is preferably situated in the area of bearing element 124 [and] is, as demonstrated, screwed to the side surface of stator 312 facing bearing element 124.

FIG. 3 moreover shows drive spindle 130 and spindle locking device 190, spindle locking device 190 being, as demonstrated, situated between drive motor 180 and drive spindle 130. At its axial end 361 on the drive side, i.e. at its end 361 facing drive motor 180, drive spindle 130 has at least one, as demonstrated three, clamping surfaces 362 for interacting with spindle locking device 190. It is pointed out that the design of clamping surfaces 362 at drive spindle 130 is only of exemplary nature and is not to be construed as a limitation to the present invention. Clamping surfaces 362 may also be designed as a separate component assigned to drive spindle 130, for example, the separate component being coupleable to drive spindle 130.

Spindle locking device 190 preferably includes at least one control element 321, a clamping ring 340 as well as at least one, as demonstrated three, blocking members 350. Control element 321 is, as demonstrated, designed in one piece with a planet carrier 320 assigned to gear unit 170 which is preferably designed as a planetary gear set. However, control element 321 may also be connected to gear unit 170 with the aid of any arbitrary connection, for example a clamping connection. In this case, control element 321 has, as demonstrated, three sections 322 as well as a recess 329, a blocking member 350 being situatable between two sections 322, which are adjacent in the circumferential direction of control element 321, in each case. Recess 329 is preferably used to situate control element 321 on drive spindle 130.

The demonstrated three blocking members 350 are preferably mounted in clamping ring 340. Here, clamping ring 340 is preferably designed to prevent blocking members 350 from escaping from control element 321 in the radial direction of drive spindle 130. Blocking members 350 are preferably clampable during the spindle locking mode of spindle locking device 190 between clamping ring 340 and a clamping surface 362 of drive spindle 130 which is assigned to particular blocking member 350. Clamping surfaces 362 are preferably designed to prevent drive spindle 130 from twisting in relation to gear unit housing 175 and thus to tool housing 105 from FIG. 1. In this case, blocking members 350 preferably have a cylindrical design, but may also have any other shape, for example spherical. A spindle locking device 190 of this type is conventional so that a detailed description thereof is dispensed with for the sake of a concise description. The spindle locking mode of spindle locking device 190 preferably takes place when a torque, which is externally applied to tool holder 140 from FIG. 1 and FIG. 2, is greater than a torque of planet carrier 320 on the drive side. An illustration of the gear unit assembly was also dispensed with for the sake of clarity.

Figure 4:
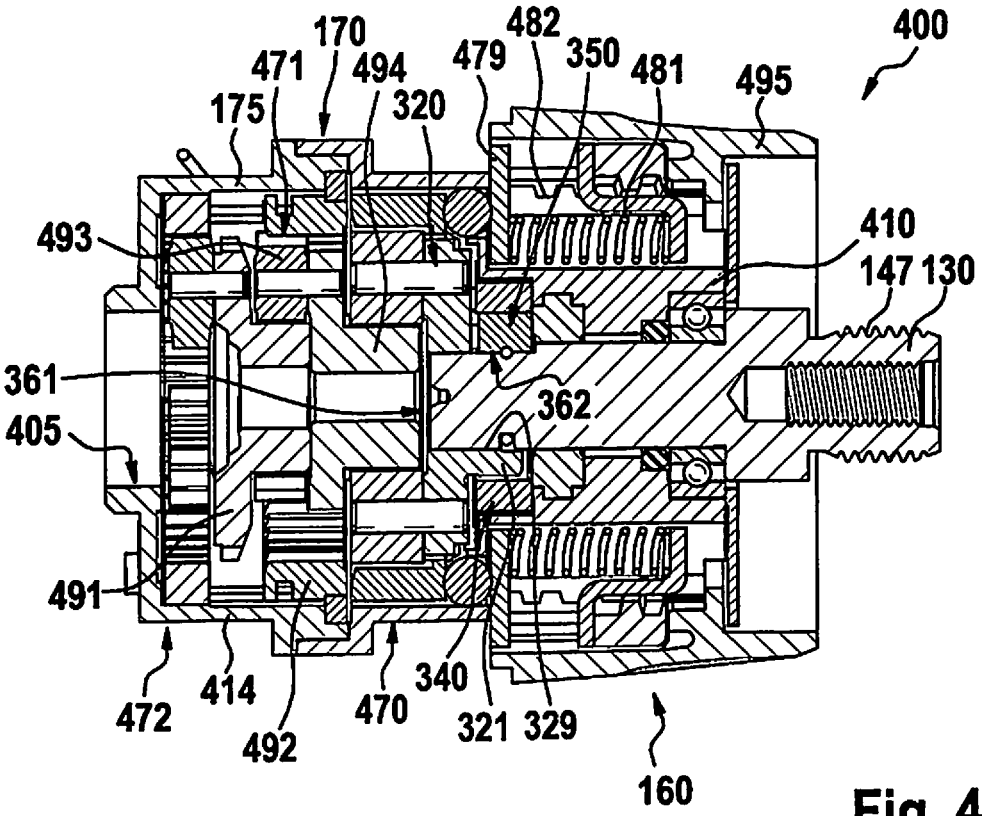
FIG. 4 shows a sectional view of a cut-through 400 of the handheld power tool from FIG. 1.

FIG. 4 shows a cut-through 400 of handheld power tool 100 from FIG. 1 in which an illustration of insertion tool 150 and tool holder 140 from FIG. 1 was dispensed with for the sake of clarity and simplicity of the drawing. Cut-through 400 illustrates an exemplary embodiment of gear unit 170 designed as a planetary gear set, of spindle locking device 190 as well as of optional torque clutch 160 from FIG. 1 and FIG. 2.

Planetary gear set 170 is preferably shiftable between a first and a second gear and has by way of example three gears or planetary stages: a front stage 470, a central stage 471, and a rear stage 472. Central planetary stage 471 has by way of example a sun wheel 491 including at least one planet wheel 492, a planet carrier 494 together with the sun wheel of next planetary stage 470, as well as a ring gear 492. Here, sun wheel 491 is preferably movable in the radial direction of gear unit 170 by at least 0.2 mm in relation to ring gear 492. It is pointed out that the sun wheels of the two other planetary stages 470, 472 may also be radially movable. The torque of drive motor 180 is transferred to drive spindle 130 via planetary stages 472, 471, 470 with the aid of a rotary driving contour of planet carrier 320. In this case, gear unit housing 175 has a bearing point 405 for supporting drive shaft 182 via bearing element 124. Since the design of a planetary gear set is sufficiently known to those skilled in the art, a further description of planetary stages 470, 472 is dispensed with for the sake of a concise description.

Planetary stages 470, 471, 472 are situated by way of example in gear unit housing 175 which preferably has a two-part design and which is, as demonstrated, divided into a front section 410 (on the right-hand side in FIG. 4) and a rear section 414 (on the left-hand side in FIG. 4) which is fastened to the front section. In rear section 414, planetary stages 471, 472 are situated as demonstrated. In the outer periphery of front section 410, a male thread 482 is formed as demonstrated, at which a torque adjusting sleeve 495 which is assigned to optional torque clutch 160 and which is coupled to a circular limiting transfer element 479 on which spring pressure is applied by a plurality of helical compression springs 481 is rotatably mounted by way of example. Since the design of a torque clutch is sufficiently known to those skilled in the art, a further description is dispensed with for the sake of a concise description.

FIG. 4 furthermore illustrates spindle locking device 190 from FIG. 3 in the spindle locking mode. Here, the demonstrated one blocking member 350 is situated at a clamping surface 362 of drive spindle 130, clamping ring 340 preventing blocking member 350 from escaping from control element 321 in the radial direction of drive spindle 130. In this case, clamping surface 362 prevents drive spindle 130 from twisting in relation to gear unit housing 175 and thus to tool housing 105 from FIG. 1.

Figure 5:
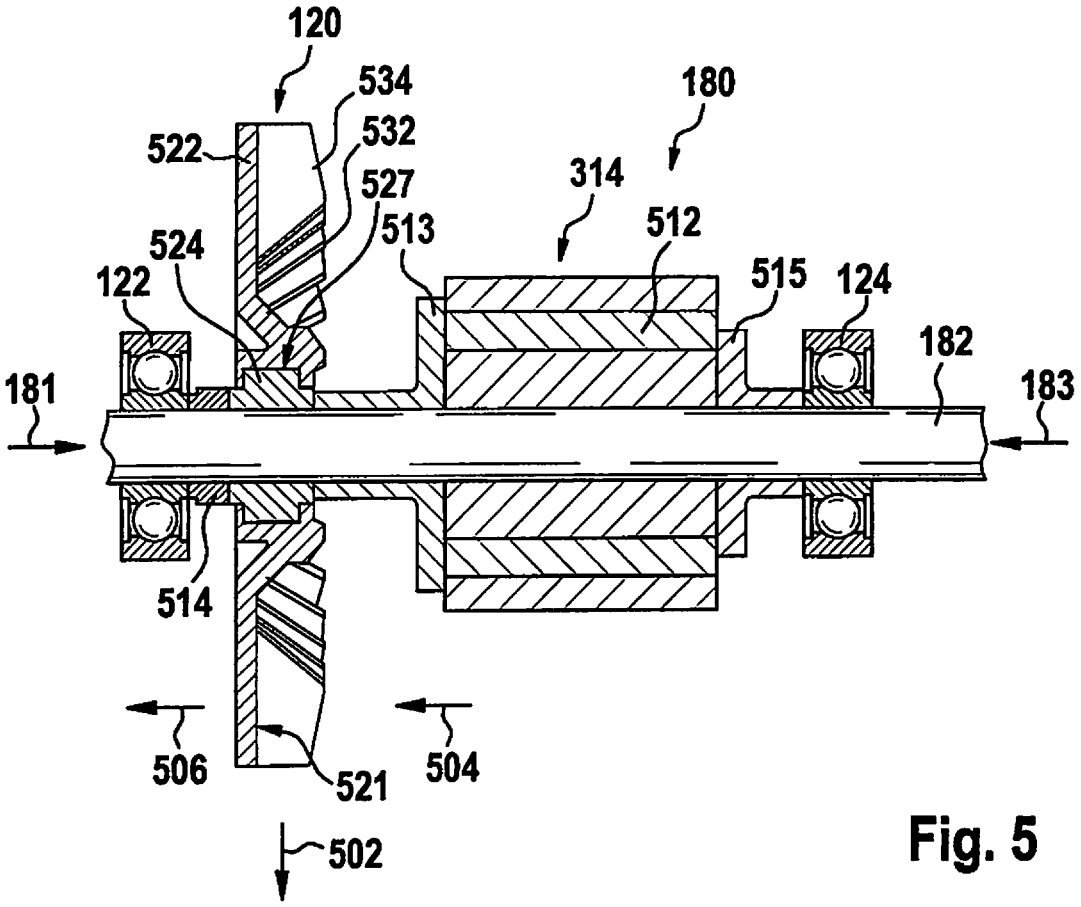
FIG. 5 shows a sectional view of the drive motor and the fan wheel from FIG. 3.

FIG. 5 shows an exemplary arrangement of fan wheel 120 on drive shaft 182 of drive motor 180. Fan wheel 120 has, as demonstrated, a two-part design including a flange 524 for forming a force-locked connection to drive shaft 182 and an air guide member 522. Flange 524 and air guide member 522 are preferably connected to one another via any arbitrary connection 527, for example a force-locked or a form-fit connection, such as a press-fit connection. Air guide member 522 is preferably a disk, a plurality of air guide vanes 532, 534 being preferably situated on a side 521 facing drive motor 180. Two of the air guide vanes are characterized by a reference numeral 532 and 534, respectively, by way of example. Here, flange 524 and air guide member 522 may preferably include different materials, for example a composite material which includes at least plastic or two different metals. In this case, at least 20 percent by volume of fan wheel 120 includes a metal having a density greater than or equal to 3.5 g/cm$^3$ as described above. Air guide member 522 preferably includes a zinc alloy and flange 524 is preferably designed as a steel bushing.

Moreover, fan wheel 120 may also be designed as a single piece. Fan wheel 120 is preferably designed as a hybrid fan which is preferably designed to take in air in the axial direction of fan wheel 120 or along an air flow direction 504 and to release it in the radial direction of fan wheel 120 or along an air flow direction 502 and/or in the axial direction of fan wheel 120 or along an air flow direction 506. However, fan wheel 120 may also be designed as a radial fan or as a diagonal fan.

Moreover, FIG. 5 illustrates drive motor 180 from FIG. 1, which is preferably designed as an electronically commutated drive motor, including rotor 314 which preferably has a laminated armature core preferably made of sheet steel and/or is provided with at least one permanent magnet 512. The at least one permanent magnet 512 is preferably rod-shaped and/or preferably includes rare earth elements. Furthermore, a spacer element 514, 513, 515 is situated in each case by way of example for secure positioning on drive shaft 182 between bearing element 122 and fan wheel 120, between fan wheel 120 and drive motor 180 as well as between drive motor 180 and bearing element 124.

What is claimed is:

1. A handheld power tool, comprising:

a tool housing in which a drive motor for driving a drive spindle is situated, the drive spindle being assigned a tool holder for accommodating an insertion tool and the drive spindle being assigned a spindle locking device which is designed to prevent the drive spindle from twisting in relation to the tool housing during a spindle locking mode; and a fan wheel to cool the drive motor, at least 20 percent by volume of the fan wheel including a metal having a density of greater than or equal to 3.5 g/cm$^3$, wherein the fan wheel includes a flange for forming a force-locked connection to a drive shaft which is assigned to the drive motor, wherein the drive shaft is rod-shaped, wherein the fan wheel is situated between two bearing elements, wherein the two bearing elements are configured to mount the drive shaft to the tool housing, wherein the two bearing elements are directly connected to the drive shaft, wherein the fan wheel includes at least one of zinc, a zinc alloy, brass and steel, wherein the drive motor is an electronically commutated drive motor including a stator and a rotor which is provided with at least one permanent magnet, wherein a center of gravity of the handheld power tool is situated in a handle area of the handheld power tool, and wherein:

a first spacer element is situated for secure positioning on the drive shaft between a first bearing element of the two bearing elements and the fan wheel, a second spacer element is situated for secure positioning on the drive shaft between the fan wheel and the drive motor, and a third spacer element is situated for secure positioning on the drive shaft between the drive motor and the second bearing element of the two bearing elements.

2. The handheld power tool as recited in claim 1, wherein the fan wheel includes a composite material which includes at least one of plastic or two different metals.

3. The handheld power tool as recited in claim 1, wherein a gear unit is situated between the drive motor and the tool holder, the gear unit being a planetary gear set and includes at least one planetary stage.

4. The handheld power tool as recited in claim 3, wherein the at least one planetary stage includes at least one sun wheel and a ring gear, the sun wheel being movable in a radial direction of the gear unit by at least 0.2 mm in relation to the ring gear.

5. The handheld power tool as recited in claim 3, wherein the spindle locking device is situated between the gear unit and the tool holder.

6. The handheld power tool as recited in claim 3, wherein a torque clutch is situated between the gear unit and the tool holder.

7. The handheld power tool as recited in claim 1, wherein the drive motor is situated in the area of a handle which is assigned to the tool housing.

8. The handheld power tool as recited in claim 1, wherein the drive spindle is assigned at least one clamping surface which is assigned the spindle locking device including a clamping ring and at least one blocking member, the at least one blocking member being clampable between the at least one clamping surface and the clamping ring during the spindle locking mode of the spindle locking device to prevent the drive spindle from twisting in relation to the tool housing.

9. The handheld power tool as recited in claim 8, wherein the at least one blocking member has a cylindrical design.

10. The handheld power tool as recited in claim 3, wherein a second fan wheel is situated between the drive motor and the gear unit.

11. The handheld power tool as recited in claim 1, wherein the spindle locking device includes at least one control element which is designed in one piece with a planet carrier of the gear unit.

12. The handheld power tool as recited in claim 8, wherein the at least one blocking member includes three blocking members which are mounted in the clamping ring.

13. The handheld power tool as recited in claim 1, wherein the fan wheel has a two-part design including a flange for forming a force-locked connection to the drive shaft and an air guide member.

14. The handheld power tool as recited in claim 13, wherein the flange and the air guide member are connected to one another via a press-fit connection.

15. A handheld power tool, comprising:

a tool housing in which a drive motor for driving a drive spindle is situated, the drive spindle being assigned a tool holder for accommodating an insertion tool and the drive spindle being assigned a spindle locking device which is configured to prevent the drive spindle from twisting in relation to the tool housing during a spindle locking mode;

a gear unit, wherein the gear unit is situated between the drive motor and the tool holder, the gear unit being a planetary gear set and includes at least one planetary stage; and a fan wheel to cool the drive motor, at least 20 percent by volume of the fan wheel including a metal having a density of greater than or equal to 3.5 g/cm$^3$, wherein the spindle locking device is situated between the gear unit and the tool holder, wherein the drive motor includes a drive shaft for driving the drive spindle connected to the tool holder and the drive motor is connected to the drive spindle via the gear unit and the spindle locking device, wherein the drive shaft and the gear unit are situated in the tool housing, wherein the drive shaft is mounted in each case via two bearing elements in the tool housing, wherein a first bearing element of the two bearing elements is situated at an end facing away from the tool holder and a second bearing element of the two bearing elements is situated at an end facing the tool holder, wherein the fan wheel is arranged on the drive shaft, wherein the fan wheel is situated between the two bearing elements, wherein the fan wheel includes an air guide member, wherein the air guide member includes a disk with a plurality of air guide vanes, wherein the fan wheel is configured for drawing in air in an axial direction of the fan wheel or along an air-flow direction essentially parallel to the drive shaft and giving off air in a radial direction of the fan wheel or along an air-flow direction essentially perpendicular to the drive shaft and/or in the axial direction of the fan wheel, wherein:

a first spacer element is situated for secure positioning on the drive shaft between a first bearing element of the two bearing elements and the fan wheel, a second spacer element is situated for secure positioning on the drive shaft between the fan wheel and the drive motor, and a third spacer element is situated for secure positioning on the drive shaft between the drive motor and the second bearing element of the two bearing elements.

16. The handheld power tool as recited in claim 15, wherein the fan wheel includes at least one of zinc, a zinc alloy, brass and steel.

17. The handheld power tool as recited in claim 15, wherein the fan wheel includes a flange for forming a force-locked connection to the drive shaft which is assigned to the drive motor.

18. The handheld power tool as recited in claim 15, wherein the fan wheel is situated between the drive motor and the bearing element supported in the tool housing at the end facing away from the tool holder.

19. The handheld power tool as recited in claim 15, wherein the fan wheel is situated between the drive motor and the bearing element supported in the tool housing at the end facing the tool holder.

20. The handheld power tool as recited in claim 15, wherein the fan wheel is situated between the drive motor and the gear unit.

21. The handheld power tool as recited in claim 15, wherein the air guide vanes are situated on a side of the disk facing the drive motor.

22. The handheld power tool as recited in claim 15, wherein the air guide vanes are situated on a side of the disk facing the gear unit.

23. The hand-held power tool as recited in claim 15, wherein the fan wheel is configured for giving off air in an air-flow direction towards the bearing situated at the end facing away from the tool holder.

24. The hand-held power tool as recited in claim 15, wherein the handheld power tool comprises a motor electronics system assigned to the drive motor, wherein the motor electronics system is situated between the drive motor and the gear unit or between the fan wheel and the drive motor.

25. The hand-held power tool as recited in claim 24, wherein the air guide vanes are situated on a side of the disk facing the motor electronics system.

26. The hand-held power tool as recited in claim 15, wherein the drive shaft is in the shape of a rod.

27. The hand-held power tool as recited in claim 15, wherein the air guide vanes are arranged essentially perpendicular on the disk.

28. The hand-held power tool as recited in claim 15, wherein the air guide vanes are arranged along a radial direction of the fan wheel pointing outwards from the drive shaft.

29. The hand-held power tool as recited in claim 15, wherein the disk is essentially perpendicular to the drive shaft.

30. The hand-held power tool as recited in claim 1, wherein the fan wheel increases a rotary inertia of the drive motor.

31. The hand-held power tool as recited in claim 15, wherein the fan wheel increases a rotary inertia of the drive motor.

* * * * *